US006494815B1

(12) United States Patent
Welsh, Jr.

(10) Patent No.: US 6,494,815 B1
(45) Date of Patent: Dec. 17, 2002

(54) WALKER WITH CONSTANTLY APPLIED BRAKE

(75) Inventor: Thomas J. Welsh, Jr., Aurora, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 09/507,332

(22) Filed: Feb. 18, 2000

(51) Int. Cl.[7] ..... A63B 22/20

(52) U.S. Cl. ..... 482/68; 482/66; 280/87.051

(58) Field of Search ..... 280/87.051, 647, 280/33.994, 87.021, 650, 87.03, 648; 188/20, 72.9; 297/5; 482/66, 68, 67

(56) References Cited

U.S. PATENT DOCUMENTS

| | | | | |
|---|---|---|---|---|
| 8,478 A | | 10/1851 | Rice | |
| 368,477 A | | 8/1887 | Lane et al. | |
| 432,378 A | | 7/1890 | Davidson et al. | |
| 517,403 A | | 3/1894 | Bradish et al. | |
| 1,463,820 A | | 8/1923 | Humphreville | |
| 2,278,901 A | | 4/1942 | Smock | 155/22 |
| 2,308,626 A | | 1/1943 | Reinholz | 155/23 |
| 2,475,130 A | | 7/1949 | Davis | 118/5 |
| 2,537,909 A | | 1/1951 | Puddester | 155/30 |
| 2,765,839 A | | 10/1956 | Arpin | 155/24 |
| 2,812,012 A | | 11/1957 | Hansburg | 155/123 |
| 2,862,710 A | | 12/1958 | Lewis | 272/33 |
| 2,910,111 A | | 10/1959 | Hansburg | 155/22 |
| 3,078,479 A | | 2/1963 | Grosse et al. | 5/104 |
| 3,145,048 A | | 8/1964 | Dowdy et al. | 297/5 |
| 3,183,028 A | | 5/1965 | Williams | 293/62 |
| 3,279,567 A | * | 10/1966 | Kempel | 188/176 |
| 3,366,201 A | | 1/1968 | Pesta | 188/110 |
| 3,425,709 A | | 2/1969 | Fields | 280/79.2 |
| 3,623,575 A | | 11/1971 | Joseph et al. | |
| 3,710,895 A | | 1/1973 | Freedman | 188/5 |
| 3,788,695 A | | 1/1974 | Salem | 297/6 |
| 3,796,430 A | | 3/1974 | Sudo | 272/70.3 |
| 3,954,160 A | | 5/1976 | Carr | 188/106 F |
| 4,019,756 A | | 4/1977 | Ishida | 280/649 |
| 4,045,045 A | | 8/1977 | Boucher et al. | 280/87.02 |
| 4,084,663 A | | 4/1978 | Haley | 188/31 |
| 4,108,468 A | | 8/1978 | Orlanski | 280/648 |
| 4,160,553 A | | 7/1979 | Fleischer | 280/87.02 |
| 4,211,309 A | * | 7/1980 | Ruggiero | 188/83 |
| 4,211,426 A | | 7/1980 | Motloch | 280/87.02 |
| 4,225,146 A | | 9/1980 | Takeuchi | 280/87.02 |
| 4,231,582 A | | 11/1980 | Moss | 280/87.02 |
| 4,359,242 A | | 11/1982 | Gerken et al. | 297/5 |
| 4,360,951 A | | 11/1982 | Bucher | 16/35 R |
| 4,361,216 A | | 11/1982 | Overbeek | 192/36 |
| 4,364,576 A | | 12/1982 | Kassai | 280/87.02 |
| 4,433,869 A | | 2/1984 | Payne, Jr. et al. | 297/5 |
| 4,503,943 A | | 3/1985 | Tsukui | 188/5 |
| 4,576,392 A | | 3/1986 | Quinlan, Jr. | 280/87.02 |
| 4,579,359 A | | 4/1986 | Schwartz | 280/87.02 |

(List continued on next page.)

FOREIGN PATENT DOCUMENTS

| | | |
|---|---|---|
| WO | WO 84/03073 | 8/1984 |
| WO | WO 97/38887 | 10/1997 |

OTHER PUBLICATIONS

*Walkers*, Kolcraft Enterprises, Inc. 1997 Catalog, pp. 1 and 17.

*Primary Examiner*—Jerome W. Donnelly
*Assistant Examiner*—Tam Nguyen
(74) *Attorney, Agent, or Firm*—Marshall, Gerstein & Borun

(57) ABSTRACT

A walker for a toddler or infant is disclosed. The walker has a base and a seat operatively coupled to the base. It also includes a plurality of rollers for supporting the base on a walking surface such as a floor. The walker also includes a brake which is positioned to constantly apply friction to at least one of the rollers to thereby inhibit the travel speed of the walker.

10 Claims, 7 Drawing Sheets

U.S. PATENT DOCUMENTS

| | | | | | |
|---|---|---|---|---|---|
| 4,615,523 | A | | 10/1986 | Chen | 272/70.3 |
| 4,618,033 | A | | 10/1986 | Kassai | 188/20 |
| 4,633,544 | A | | 1/1987 | Hicks | 16/35 R |
| 4,699,392 | A | | 10/1987 | Ku | 280/87.02 |
| 4,714,141 | A | | 12/1987 | Kassai | 188/20 |
| D295,397 | S | | 4/1988 | Brownlie et al. | D12/130 |
| 4,759,098 | A | | 7/1988 | Ko | 16/29 |
| 4,759,541 | A | | 7/1988 | Chen | 272/70.3 |
| 4,773,639 | A | | 9/1988 | Graves | 272/70.3 |
| 4,799,700 | A | | 1/1989 | Knoedler et al. | 280/87.051 |
| 4,815,569 | A | | 3/1989 | Norman | 188/5 |
| 4,819,767 | A | | 4/1989 | Laird | 188/2 D |
| 4,822,030 | A | | 4/1989 | Cone | 272/70.3 |
| 4,844,209 | A | | 7/1989 | Sedlack | 188/5 |
| 4,884,799 | A | | 12/1989 | Chai | 272/70.3 |
| 4,953,667 | A | | 9/1990 | Bigo | 188/31 |
| 4,988,138 | A | | 1/1991 | Danna et al. | 293/127 |
| 5,001,808 | A | | 3/1991 | Chung | 16/18 CG |
| 5,002,163 | A | * | 3/1991 | Kidd | 188/83 |
| 5,040,641 | A | | 8/1991 | Phillips et al. | 188/1.12 |
| 5,054,851 | A | | 10/1991 | Chiu | 297/136 |
| 5,056,805 | A | | 10/1991 | Wang | 280/47.36 |
| 5,080,383 | A | | 1/1992 | Hsieh | 280/87.051 |
| 5,112,044 | A | | 5/1992 | Dubats | 482/68 |
| 5,168,601 | A | | 12/1992 | Liu | 16/126 |
| 5,203,581 | A | | 4/1993 | Jankowski | 280/87.051 |
| 5,244,443 | A | | 9/1993 | Cerda | 482/68 |
| 5,273,147 | A | | 12/1993 | Beigang et al. | 192/104 B |
| 5,324,064 | A | | 6/1994 | Sumser et al. | 280/649 |
| 5,342,072 | A | | 8/1994 | Prasad | 280/87.051 |
| 5,366,231 | A | | 11/1994 | Hung | 281/87.051 |
| 5,383,542 | A | | 1/1995 | Stockton | 192/45.1 |
| 5,433,682 | A | | 7/1995 | Fermaglich et al. | 482/66 |
| 5,449,185 | A | | 9/1995 | Sykes | 280/87.051 |
| 5,465,986 | A | * | 11/1995 | MacRae | 280/33.994 |
| 5,518,475 | A | | 5/1996 | Garland | 482/68 |
| 5,529,150 | A | | 6/1996 | Buckley et al. | 188/72.9 |
| 5,564,724 | A | | 10/1996 | Huang | 280/87.051 |
| 5,590,892 | A | | 1/1997 | Hu | 280/87.051 |
| 5,813,681 | A | * | 9/1998 | Saint et al. | 188/20 |
| 6,260,867 | B1 | * | 7/2001 | Yang et al. | 188/20 |

* cited by examiner

WALKER WITH CONSTANTLY APPLIED BRAKE

FIELD OF THE INVENTION

The invention relates generally to infant walkers, and, more particularly, to a toddler or infant walker with a constantly applied brake.

BACKGROUND OF THE INVENTION

Infant or toddler walkers have long been known in the art. A conventional walker includes a base, a seat, a support coupling the seat to the base and a plurality of free moving rollers. When placed in the seat, an infant or toddler is supported with their feet touching a ground surface such as a floor. The infant or toddler can then roll the walker by moving their feet against the ground surface.

Various walkers have been developed that attempt to control the manner in which the walker can be propelled. For example, some prior art walkers employ complicated clutch mechanisms that suddenly engage to stop the walker when a certain speed is reached. Other prior art walkers include rollers which freely rotate in one direction, but are unable to roll in the reverse direction to prevent the walker from moving backward.

SUMMARY OF THE INVENTION

In accordance with an aspect of the invention, a walker is disclosed. The walker includes a base and a seat operatively coupled to the base. The walker also includes a plurality of rollers for supporting the base. In addition, the walker is provided with a brake positioned to constantly apply friction to at least one of the plurality of rollers.

In accordance with another aspect of the invention, a walker is disclosed which includes a base and a seat operatively coupled to the base. The walker also includes a roller coupled to the base for rotation in a first direction and a second direction opposite the first direction. The walker also includes a spring positioned to constantly force contact between the roller and a braking surface to thereby inhibit rotation of the roller.

In accordance with still another aspect of the invention, a method is disclosed for inhibiting a travel speed of the walker. The method comprises the step of providing a walker with a base, a seat supported by the base, and a roller coupled to the base. The method also includes the step of employing a spring to constantly create friction between the roller and a braking surface to thereby inhibit rotation of the roller.

In the preferred embodiments, the brake further comprises a braking surface and a spring positioned to cause frictional engagement between the at least one of the rollers and the braking surface.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
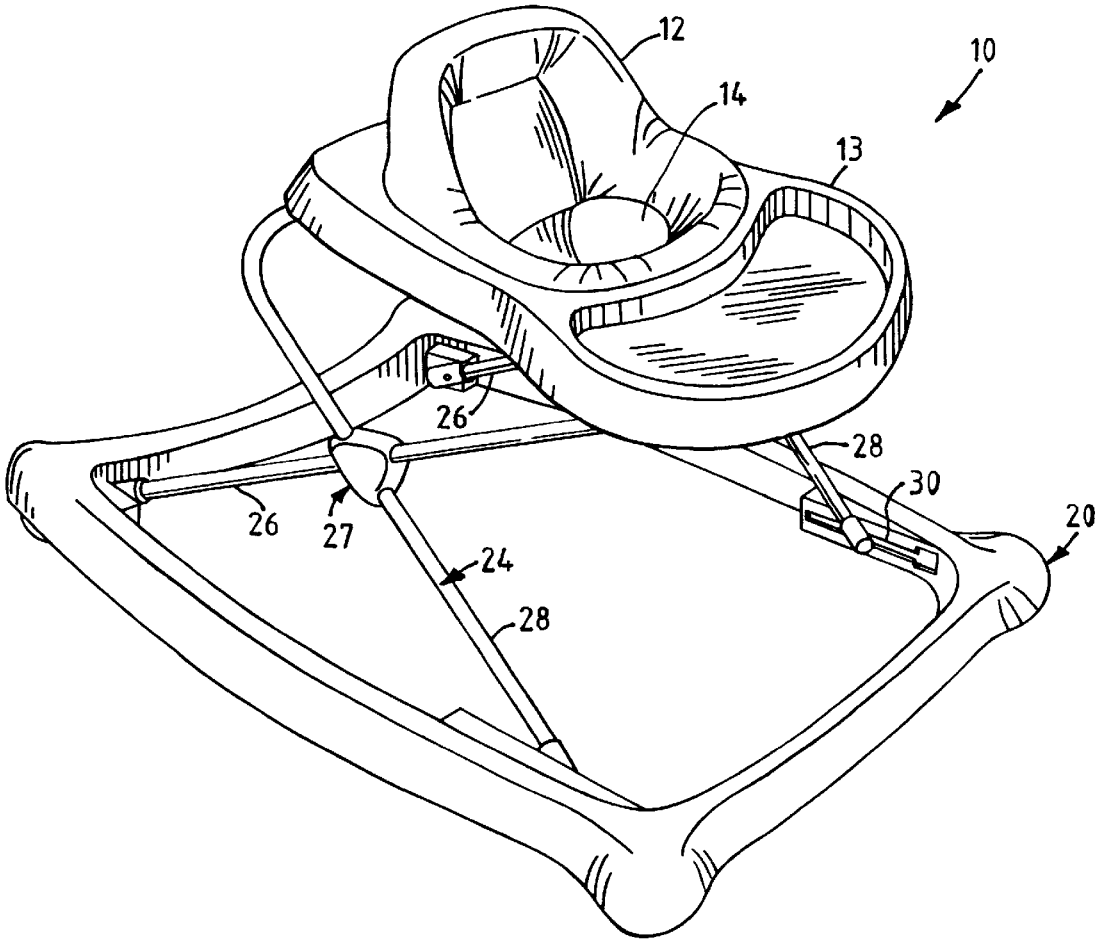
FIG. 1 is a perspective view of a walker constructed in accordance with the teachings of the instant invention.

A walker 10 constructed in accordance with the teachings of the invention is shown generally in FIG. 1. Although for purposes of illustration, a specific walker 10 is shown and described, persons of ordinary skill in the art will readily appreciate that the teachings of the invention are not limited to use with any particular walker or in any other specific environment of use. On the contrary, the teachings of the invention can be employed with any walker that would benefit from the enhanced speed control it provides.

For the purpose of supporting an infant or toddler in an upright position, the walker 10 is provided with a seat 12. In the illustrated walker 10, the seat 12 comprises a fabric covering secured to, and suspended within, a plastic frame 13. The fabric seat 12 includes a pair of leg openings 14 through which a child's legs extend when the child is positioned in the seat.

In the illustrated walker 10, the seat frame 13 includes an integral tray positioned in front of the seat 12 for supporting toys, food, etc.

The walker 10 is further provided with a base 20. The base 20 is preferably made of molded plastic. In the illustrated walker 10, the base 20 defines a generally rectangular ring with a continuous perimeter. The center of the base 20 is open and the seat 12 is positioned so that the feet of a child located in the seat 12 can extend through the base 20 and contact the ground surface on which the walker 10 is supported.

In order to render the walker 10 usable with children of different heights and leg lengths, the seat 12 is coupled to the base 20 by a conventional adjustable frame 24. As shown in FIG. 1, the adjustable frame 24 includes two U-shaped supports 23, 25 (see FIG. 2). The U-shaped supports 23, 25 are oppositely oriented such that one of the supports 25 defines a pair of rear legs 26 and the other support 25 defines a pair of forward legs 28. Each of the rear legs 26 is pivotably coupled to an inner surface of the base 20 at the rear of the base 20 by a pivot pin in a conventional manner. The front legs 28, on the other hand, are coupled to pegs (not shown) which are sized and positioned to slide in grooves 30 defined in a forward, inner surface of the base 20. Each side of the U-shaped supports 23, 25 cross and are connected for pivoting relative movement by a fastener (not shown) and two plastic housings 27 (i.e., four housings 27 total). The housings 27 in each pair are pivotable relative to one another.

The upper ends of the U-shaped supports 23, 25 are pivotably secured to the frame 13. In particular, a central bar 32 of U-shaped support 23 is pivotably fastened to a bottom surface of the seat support 13 by a holder 34. A central bar 36 of the other U-shaped bar 25 is also fastened to the undersurface of the seat support 13 by a holder 38. However, whereas the holder 34 only permits the central bar 32 to rotate, the holder 38 permits both rotation and translation of the central bar 36 to permit adjustment of the height of the seat 12 relative to the base 20. Preferably, the U-shaped supports 23, 25 can be manipulated such that the seat 12 can be positioned adjacent the base 20 when storage of the walker 10 is desired.

To releasably lock the seat 12 in the upright position, the holder 38 is provided with a conventional lock mechanism 39. As any locking mechanism can be employed in this role, and the structure of the lock mechanism is immaterial to the invention, in the interest of brevity the lock mechanism is not further described herein.

Figure 2:
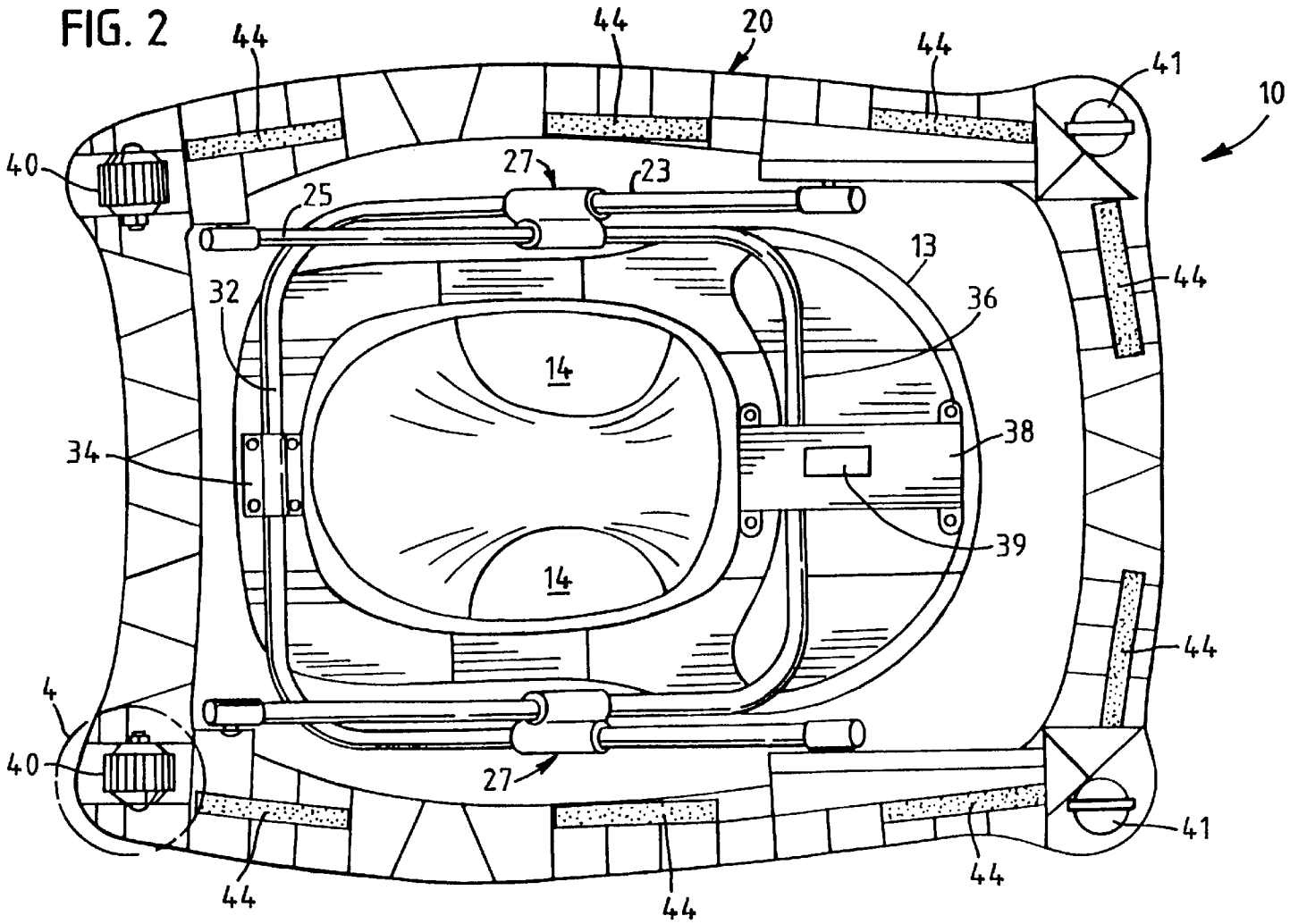
FIG. 2 is a bottom view of the walker of FIG. 1.

To support the base 20 on the ground surface, the walker 10 is further provided with a plurality of rollers 40, 41. As shown in FIG. 2, in the illustrated walker, each of the rollers 40, 41 is located on a corner of the base 20. The rollers 41 located at the forward corners of the base 20 are conventional casters mounted for 360° rotation about a shaft. Thus, the forward casters 41 can roll easily in any direction.

Figure 3:
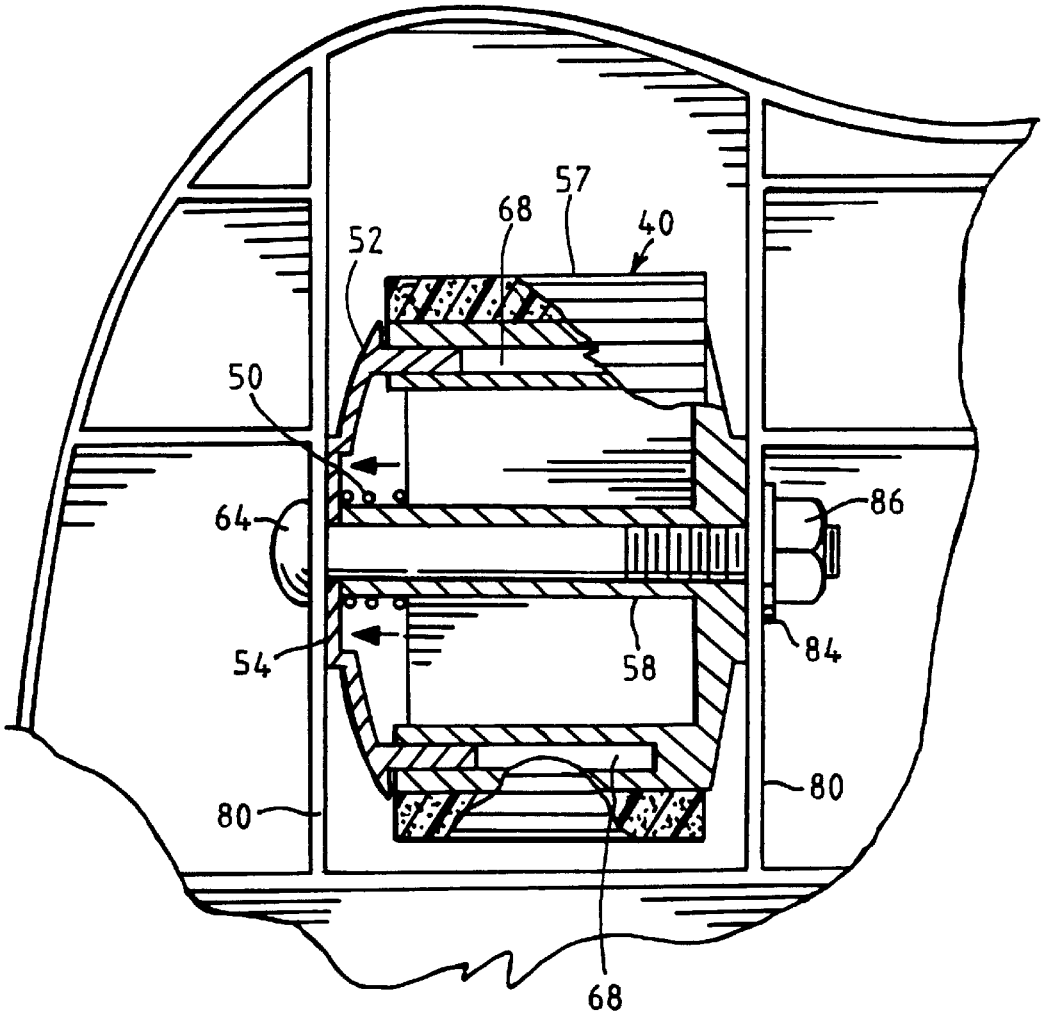
FIG. 3 is an enlarged view of the portion of FIG. 2 which is circled and labeled "3".

As most easily seen in FIG. 3, the rearmost casters 40 are each mounted to the base 20 for rotation about a horizontally mounted axis. As a result, the rearmost rollers 40 are restricted to forward and rearward rolling movement. As explained below, the rollers 40 are each provided with rubber tires 56 that substantially prevent the rollers from sliding sideways.

If the walker 10 is inappropriately employed in a location near a drop-off(e.g., a set of stairs, a sunken floor, etc.), it is possible for the walker 10 to be propelled such that a portion of the base 20 and one or two of the rollers 40 passes over the drop-off. To reduce the likelihood that the walker 10 will fall completely off of the drop-off, the walker 10 is further provided with a plurality of friction pads 44. As shown in FIG. 2, in the illustrated walker 10, the friction pads 44 are rectangular pieces of rubber secured at various positions along the undersurface of the base 40. The friction pads 44 are located such that, if one or two rollers 40 passes over a drop-off, the base 20 will move downward with the roller(s) under the force of gravity until one or more of the friction pads 44 engages the ground surface. The frictional engagement between the friction pads 44 and the ground surface reduces the likelihood that the walker 10 will completely pass over the drop-off and fall. However, despite the enhanced safety provided by the friction strips 44, the walker 10 should still be used only under adult supervision and in a location free of drop-offs (i.e., not near stairs).

For the purpose of limiting the travel speed at which a child positioned in the seat 12 can propel the walker 10, the walker 10 is further provided with means for constantly applying friction to the rear roller(s) 40. While as demonstrated by the alternative embodiments illustrated in FIGS. 5–7, the friction applying means can be implemented in many equivalent ways without departing from the scope or spirit of the invention, in the example shown in FIGS. 1–4, the friction applying means is implemented by a brake comprising a spring 50, a hub cover 52 and a braking surface 54 coupled to the base 20 as explained in detail below. Again, although as demonstrated in the various alternative embodiments the brake can be implemented in many ways without departing from the scope or spirit of the invention, it preferably includes a braking surface and a spring positioned to cause frictional engagement between a portion of one of the rearmost rollers 40 and the braking surface. Preferably, each rear roller 40 is provided with a friction applying means.

Figure 4:
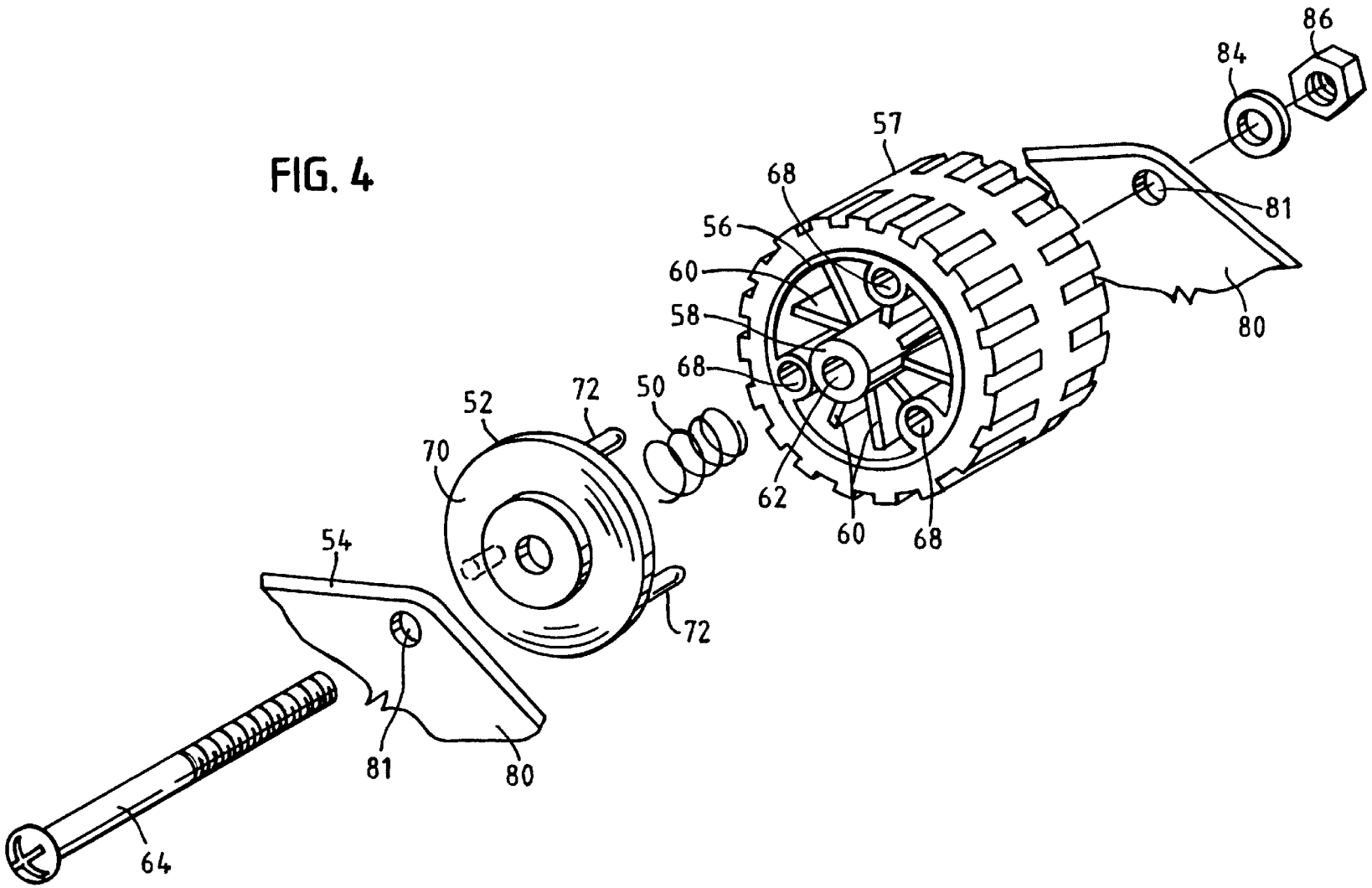
FIG. 4 is an exploded view of the roller and support walls shown in FIG. 3

Turning with specificity to the brake shown in FIGS. 3–4, each of the two rearmost rollers 40 is preferably implemented in substantially the same way. Therefore, the following description of one of the proximal rollers 40 is intended to serve for both rear rollers 40.

The roller 40 includes a cylindrical body 56. As shown in FIG. 4, a rubber tire 57 with treads is mounted on the outer circumference of the body 56. The body 56 includes an inner tube 58. The inner tube 58 is supported in concentric relation to the body 56 by radial ribs 60. The inner tube 58 defines a central bore 62 which is dimensioned to slidably receive a conventional fastener 64 such as a bolt or the like. The fastener 64 forms the axis of rotation for the roller 40.

The body 56 of the roller 40 also defines three receiving holes 68 located adjacent its perimeter. The hub cover 52 is provided with a circular plate member 70 and three projections 72. The projections 72 are sized to slidably mate with the receiving holes 64 such that the hub cover 52 is moveable along the axis of rotation of the body 56. Preferably, the plate member 70 of the hub cover 52 includes a raised central portion and an annular curved portion. The raised central portion preferably has a flat upper surface.

The base 20 of the walker 10 is provided with two depending walls 80. The walls 80 each define a bore 81 which is sized to receive the fastener 64. The walls 80 are spaced a sufficient distance from one another to define a receiving chamber therebetween in which the roller 40 can be mounted for rotation. In the example shown in FIGS. 1–4, the walls 80 are substantially rigid.

In the example of FIGS. 3–4, the spring 50 is implemented by a compression coil spring which is seated on the inner tube 58. When the roller 40 is assembled and mounted on the walker 10, the spring 50 is compressed between the raised central portion of the hub cover 52 and the radial ribs 60 of the roller 40. As a result, the spring 50 applies an outwardly directed force to the hub cover 52 which biases the hub cover in a direction away from the center of the body 56 along the axis of rotation. The walls 80 and the components of the roller 40 are sized such that the spring 50 biases the raised central portion of hub cover 52 into contact with one of the walls 80. The contacted portion of the wall, therefore, comprises the braking surface 54 mentioned above. The engagement of the hub cover 52 and the braking surface inhibits rotation of the roller 40 to thereby limit the travel speed of the walker 10. As will be appreciated by a person of ordinary skill in the art, the spring force and/or the braking surface can be adjusted to obtain a braking force having a desired magnitude.

While in the example shown in FIGS. 1–4, the braking surface 54 is integrally formed with the base 20, persons of ordinary skill in the art will readily appreciate that the braking surface 54 can be implemented by a structure separate from the base 20 without departing from the scope or spirit of the invention.

To assemble the rearmost rollers 40 of FIGS. 1–4, the spring 50 is first seated on the inner tube 58. The hub cover 52 is then positioned on the body 56 with the extensions 72 located in the receiving bores 68. With the hub cover 52 compressing the spring 50, the assembled cover 52, spring 50 and body 56 are positioned between the walls 80 of the base 20. The fastener 64 is then slid through the bore 81 in a first one of the walls 80, a bore in the hub cover 52, the bore 62 in the inner tube 58, and the bore 81 in the second wall 80. A washer 84 and a nut 86 are then threaded onto the fastener 64 to secure the roller 40 to the base 20. If the roller 40 is then rotated about the fastener 64, the raised portion of the hub cover 52 forms a rotating surface that abuts the braking surface 54 to create friction that limits the speed of rotation of the roller 40.

The apparatus described below are similar in many respects to the roller assembly described above in connection with FIGS. 3–4. Like parts have been labeled with like reference numerals but increased by "100" in FIG. 5, increased by "200" in FIG. 6 and by "300" in FIG. 7. All four of the disclosed roller assemblies shown in FIGS. 3–7 can be used with the walker 10 shown in FIGS. 1–2.

Figure 5:
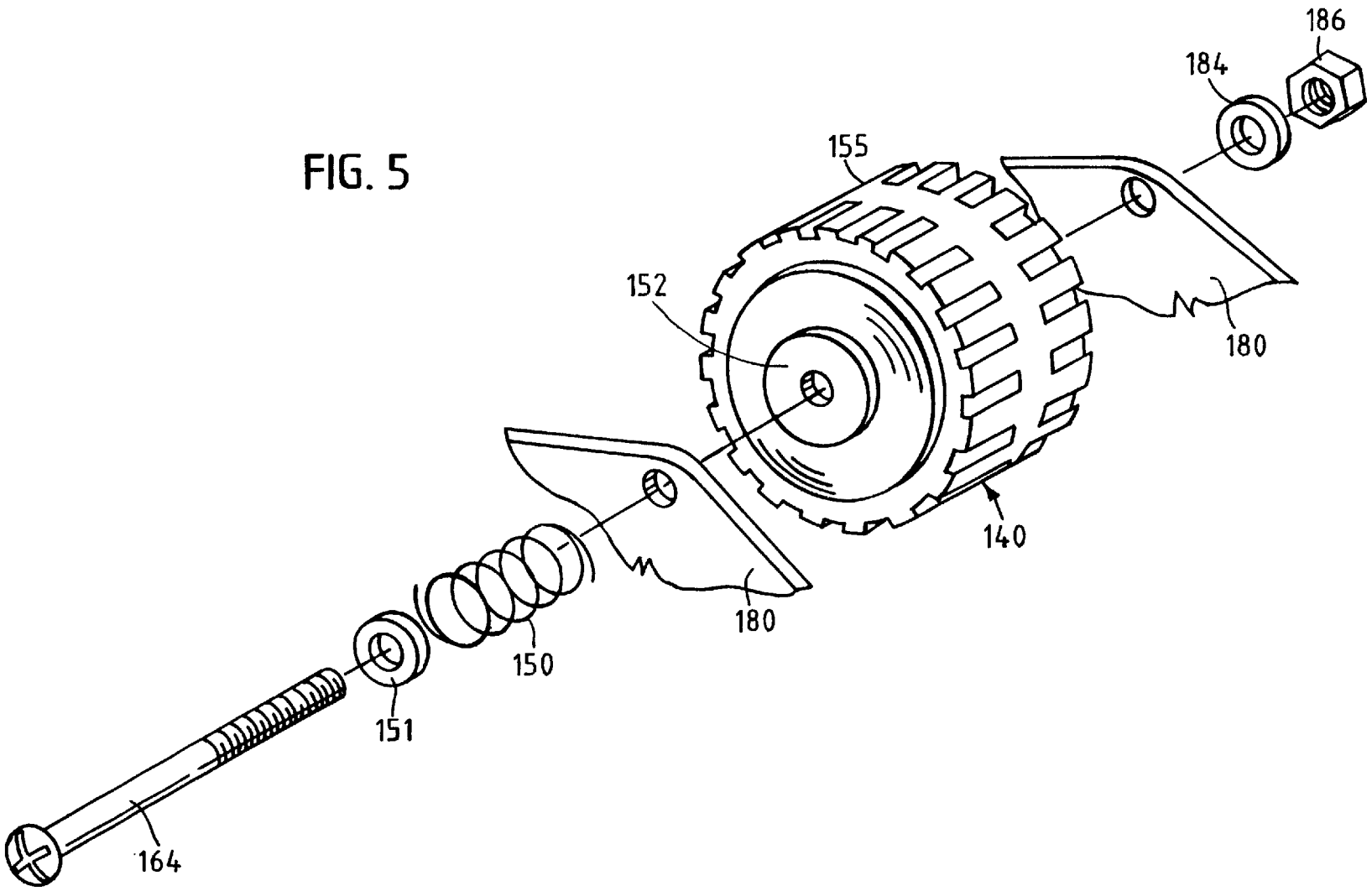
FIG. 5 is an exploded view of another roller constructed in accordance with the teachings of the invention.

A roller 140 employing an alternative friction applying means is shown in FIG. 5. Like the roller 40 described above, the roller 140 includes a body with a rubber tread 155 and a hub cover 152 with a raised central portion. Also like the roller 40 described above, the roller 140 is mounted for rotation about a horizontal axis defined by a fastener 164 journalled between two walls 180 depending from the base 20. However, unlike the roller 40, in the roller 140, the spring 150 is mounted externally to the roller 140.

More specifically, as shown in FIG. 5, the spring 150 is seated on the fastener 164 between a washer 151 and one of the walls 180. The wall 180 abutting the spring 150 is flexible, whereas the wall 180 on the opposite side of the roller 140 is rigid. As a result, when the roller 140 and spring 150 are mounted on the fastener 164 and the fastener 164 is secured in its journaled position by a washer 184 and nut 186, the spring 151 pushes or flexes the adjacent wall 180 into frictional engagement with the raised central portion of the hub cover 152. Therefore, in the example of FIG. 5, the wall 180 between the spring 150 and the roller 140 comprises the braking surface of the friction applying means and the friction generated by the braking surface and the hub cover 152 inhibits the travel speed of the walker.

Figure 6:
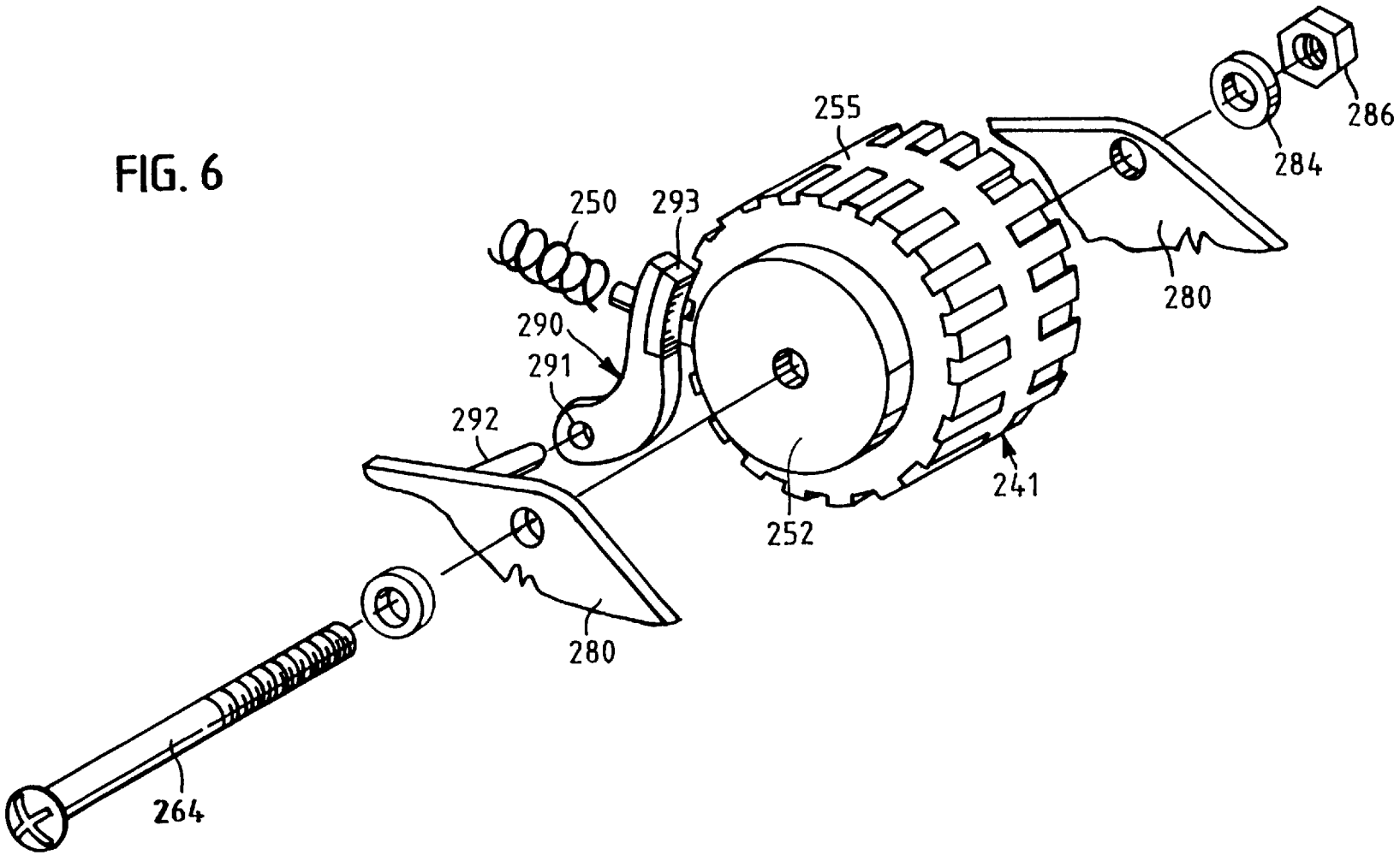
FIG. 6 is an exploded view of another roller constructed in accordance with the teachings of the invention.

Another roller 240 employing yet another friction applying means is shown in FIG. 6. As with the other rollers 40, 140, the roller 240 includes a body with a rubber tread 255 and is rotatably mounted on a fastener 264 journalled between two walls 280 depending from the base 20. The fastener 264 is secured in the journalled position by a washer 284 and nut 286.

The hub cover 252 of the roller 240 differs from the hub covers 52, 152 described above. While all of the hub covers 52, 152, 252 include a central raised portion with a bore for receiving a fastener, the central raised portion of the hub cover 252 has a larger diameter such that the perimeter of the central raised portion of the hub cover 252 is located near the tread 255.

The brake employed with the roller 240 of FIG. 6 includes a contact 290 which is mounted for pivoting movement relative to the perimeter of the raised central section of the hub cover 252. It also includes a spring 250 which biases the contact 290 into frictional engagement with the perimeter of the raised central section of the hub cover 252 to inhibit rotation (and, thus, the travel speed) of the roller 240.

More specifically, the contact 290 includes a pivotable arm 291. One end of the pivotable arm 291 is mounted on a pivot pin 292 extending from an inner surface of one of the walls 280. The other end of the pivotable arm 291 includes a friction pad 293 which may optionally be made of rubber. The friction pad 293 is located for engaging the perimeter of the raised central portion of the hub cover 252 to thereby inhibit rotation of the roller 240.

Figure 7:
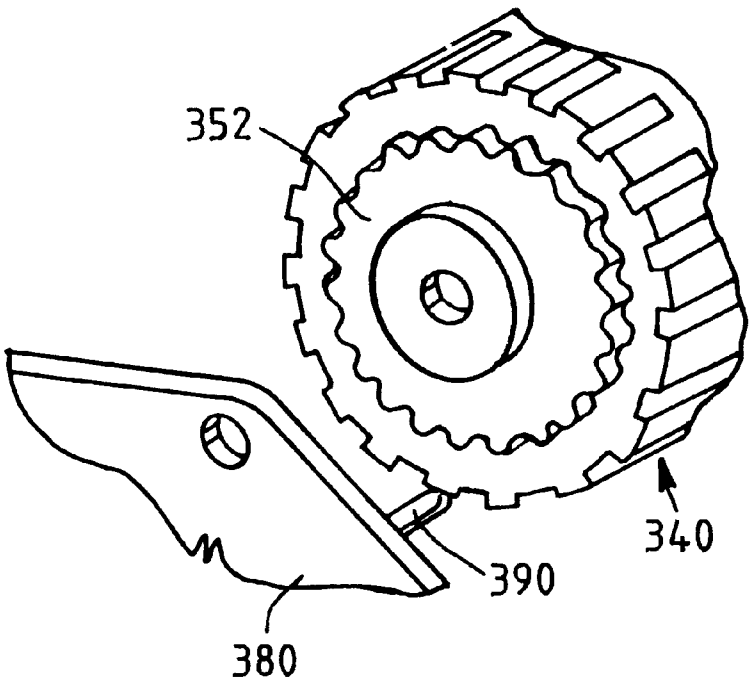
FIG. 7 is a partial exploded view of another roller constructed in accordance with the teachings of the invention.

A further roller 340 is shown in FIG. 7. The roller 340 is similar to the roller 240. However, the perimeter of the hub cover 352 is stepped such that the hub cover 352 forms a ratchet and the contact 390 is implemented by a peg mounted on a wall 380 in a position for engaging the ratchet. The contact 390 is preferably flexible and can be deflected by the rotating ratchet. The interaction of the ratchet and contact 390 provides friction to inhibit rotation of the roller 352 and creates a clicking noise when the walker moves.

Figure 8:
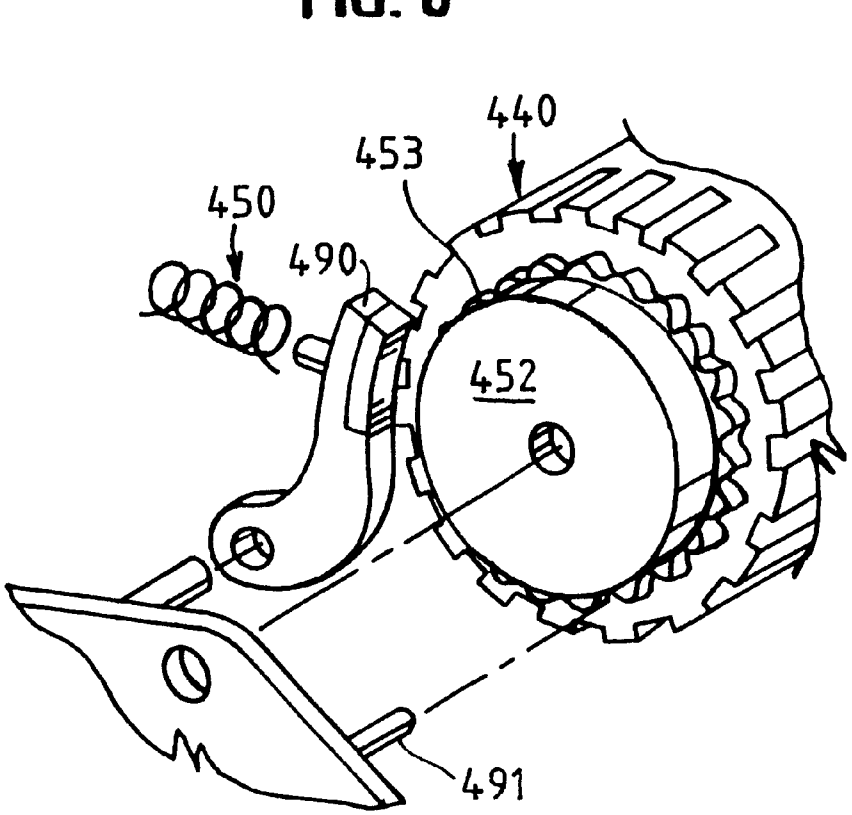
FIG. 8 is a partial exploded view of another roller constructed in accordance with the teachings of the invention.

Still another roller 440 is shown in FIG. 8. The roller 440 combines features of the rollers 240 and 340. In particular, the roller 440 includes a hub cover 452 which is similar to the hub cover 252. However, a ratchet wheel 453 similar to hub cover 352 is secured to or integrally formed with the hub cover 452. A contact 490 identical to the contact 290 is biased by a spring 450 into frictional engagement with the smooth perimeter of the hub cover 452. A second contact 491 identical to the contact 390 is positioned to engage the ratchet wheel 453 in a manner similar to the engagement of the hub cover 352 and the peg 390 of the roller 340. The interaction of the contact 490 and the hub cover 452 provides enhanced inhibition of rotation of the roller 440 relative to the roller 340, while the second contact 491 and ratchet wheel 453 provide a clicking noise as well as additional inhibition of rotation.

As still another alternative, the peg 491 can be eliminated and a shorter version of the peg 491 can be located on the contact 490 for interaction with the ratchet wheel 453. The shortened peg 491 (not shown) can be used in place of or in combination with a friction pad such as pad 293.

While the walkers described herein all employ a compression spring to create friction, persons of ordinary skill in the art will readily appreciate that other conventional springs including, by way of examples, not limitations, leaf springs, tension springs, torsion springs and Belleville springs could also be employed to generate the braking force without departing from the scope or spirit of the invention.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A walker comprising:

a base;

a seat operatively coupled to the base;

first and second rollers respectively mounted at first and second corners of the base;

third and fourth rollers respectively mounted at third and fourth corners of the base, each of the third and fourth rollers being restricted to forward and rearward rolling movement;

a first brake positioned to constantly apply friction to the third roller;

a second brake positioned to constantly apply friction to the fourth roller such that the walker is constantly braked against pivoting movement, forward movement, and rearward movement;

a braking surface; and a spring positioned to cause frictional engagement between the third roller and the braking surface, wherein the base includes a pair of walls, the third roller is mounted between the pair of walls, and at least one of the pair of walls comprises the braking surface.

2. A walker as defined in claim 1 wherein the braking surface contacts a rotating surface of the third roller.

3. A walker comprising:

a base;

a seat operatively coupled to the base;

a first roller coupled to the base for rotation in a first direction and a second direction opposite the first direction;

a first spring positioned to constantly force contact between the first roller and a first braking surface to thereby constantly inhibit rotation of the first roller;

a second roller coupled to the base for rotation in the first direction and the second direction opposite the first direction; and a second spring positioned to constantly force contact between the second roller and a second braking surface to thereby constantly inhibit rotation of the second roller such that pivoting movement, forward movement and rearward movement of the walker are inhibited; wherein the first braking surface contacts a hub cover of the first roller.

4. A walker comprising:

a base;

a seat operatively coupled to the base;

first and second contact surfaces;

a first roller coupled to the base and including: (a) a wheel body having a center; (b) a third contact surface coupled for movement relative to the wheel body; and (c) a spring located to bias the third contact surface in a direction away from the center of the wheel body and into frictional engagement with the first contact surface; and a second roller coupled to the base and including: (a) a wheel body having a center; (b) a fourth contact surface coupled for movement relative to the wheel body; and (c) a spring located to bias the fourth contact surface in a direction away from the center of the wheel body and into frictional engagement with the second contact surface such that the walker is constantly inhibited against pivoting movement, forward movement and rearward movement.

5. A walker as defined in claim 4 wherein the first contact surface comprises a portion of the base.

6. A walker as defined in claim 4 wherein the first contact surface is coupled to the base.

7. A walker as defined in claim 4 wherein the base includes a first wall and a second wall, the first roller is rotatably mounted between the first and second walls, and one of the first and second walls comprises the first contact surface.

8. A walker as defined in claim 7 wherein the first roller is rotatably mounted on a fastener journalled between the first and second walls.

9. A walker as defined in claim 4 wherein the third contact surface comprises a hub cover.

10. A walker as defined in claim 9, wherein the hub cover is coupled to the wheel body to rotate therewith and for movement relative to the wheel body in a direction perpendicular to the direction of rotation of the wheel body.

* * * * *

UNITED STATES PATENT AND TRADEMARK OFFICE

CERTIFICATE OF CORRECTION

PATENT NO. : 6,494,815 B1
DATED : December 17, 2002
INVENTOR(S) : Thomas J. Welsh, Jr.

It is certified that error appears in the above-identified patent and that said Letters Patent is hereby corrected as shown below:

Title page,
Item [56], U.S. PATENT DOCUMENTS, after "5,366,231 A 11/1994 Hung……..." please delete "281/87.051" and insert -- 280/87.051 -- in its place.
After "5,813,681 A * 9/1998 Saint et al……" please delete "188/20" and insert -- 280/87.051 -- in its place.
After "6,260,867 B1 * 7/2001 Yang et al……" please delete "188/20" and insert -- 280/87.051 -- in its place.

Signed and Sealed this

Seventeenth Day of June, 2003

JAMES E. ROGAN
*Director of the United States Patent and Trademark Office*